US006087600A

United States Patent [19]

Kaufmann et al.

[11] Patent Number: 6,087,600

[45] Date of Patent: Jul. 11, 2000

[54] KEYPAD FOR INPUT OF CONTROL COMMANDS

[75] Inventors: Meinolph Kaufmann, Bublikon; Ernst Schwarz, Nussbaumen; Hugo Felder, Buchrain, all of Switzerland

[73] Assignee: Inventio AG, Hergiswil NW, Switzerland

[21] Appl. No.: 09/298,044

[22] Filed: Apr. 22, 1999

[30] Foreign Application Priority Data

Apr. 23, 1998 [EP] European Pat. Off. ..... 98 810360

[51] Int. Cl.[7] ..... H01H 13/70

[52] U.S. Cl. ..... 200/5 A; 200/5.2; 200/302.2

[58] Field of Search ..... 200/5 A, 512–517, 200/341–344, 293, 302.1, 302.2; 400/472, 490, 491, 491.1, 491.2, 495, 495.1

[56] References Cited

U.S. PATENT DOCUMENTS

| | | | |
|---|---|---|---|
| 4,032,729 | 6/1977 | Koistinen | 200/5 A |
| 4,092,527 | 5/1978 | Luecke | 364/709 |
| 4,323,740 | 4/1982 | Balash | 200/5 A |
| 4,689,455 | 8/1987 | Watanabe | 200/340 |
| 4,703,160 | 10/1987 | Narishima et al. | 235/1 D |
| 5,481,074 | 1/1996 | English | 200/5 A |
| 5,734,136 | 3/1998 | Newcomer et al. | 200/5 A |

*Primary Examiner*—Michael Friedhofer
*Attorney, Agent, or Firm*—Schweitzer Cornman Gross & Bondell LLP

[57] ABSTRACT

This keypad for the input of control commands comprises a membrane keypad, a carrier, a keypad base and a key module. The switching operation, initiated by keys, takes place in a closed unit in the form of a carrier which encloses the keypad base and the membrane keypad. The switching contacts are located within the membrane keypad which is sealed against moisture, whereby the actual performance of the switching command take place within the sealed membrane keypad, switching plungers of the keypad base having only an actuating function. The sealed unit in the form of the carrier considerably eases installation in that the keypad base and the membrane keypad can be pre-installed in the carrier at the factory the key module can be placed over them at the installation site.

8 Claims, 7 Drawing Sheets

KEYPAD FOR INPUT OF CONTROL COMMANDS

The invention relates to a keypad for the input of control commands, particularly as used for the call input in elevators.

From U.S. Pat. No. 5,664,667 a keypad for the input of control commands has become known in which a switch carrier is equipped with pushbutton switches and is laid on a printed circuit board which has switching contacts and switching circuits. The pushbutton switches have switching plungers with contacts which, when a key is pressed, act directly on the corresponding contacts of the printed circuit board and can thereby initiate a control command.

In the keypad described above, the contact is created by the contact surface on the switching plunger of the pushbutton switch directly touching the printed circuit board or, more specifically, the contact surface on the printed circuit board. Due to the open construction of this keypad, moisture can penetrate between the switch carrier and the printed circuit board with its printed conductors and switching contacts. This leads to rapid corrosion and/or oxidation of the switching contacts and printed conductors and can lead as a result to short circuits and thereby to an unsatisfactorily short service life of the keypad. Furthermore, the force used when operating the keys is transferred directly to the contact surface of the printed circuit board and, if the force is too great, can intentionally or unintentionally lead to destruction of the keypad.

BRIEF DESCRIPTION OF THE INVENTION

The objective of the invention is to provide a keypad for the input of control commands of the type mentioned at the outset which does not have the disadvantages mentioned above.

The advantages resulting from the invention relate mainly to the fact that the switching operation to be initiated by keys which are pressed takes place within a closed unit in the form of a carrier, which contains a keypad base and a membrane keypad. Switching contacts are located inside the membrane keypad, which is sealed against moisture. More specifically, initiation of a switching command takes place by the meeting of contact surfaces within a sealed portion of the membrane keypad, whereby the switching plungers of the keypad base have only a triggering function. The closed unit in the form of the carrier also makes keypad installation considerably easier, since the keypad base and the membrane keypad can be assembled in the carrier at the factory and only a key module has to be placed over them on site. The key module may comprise individual keys supported upon a key frame by integral foil hinges. The key module may be snap-fit mounted upon the exterior of the carrier. Each key may have a stop which acts on the carrier in such a way that the travel of the key is limited by the stop even when the force applied to the key is excessive.

BRIEF DESCRIPTION OF THE DRAWINGS

A more detailed description of an illustrative embodiment of the invention which follows is set forth in the annexed drawings. The drawings are as follows.

DETAILED DESCRIPTION OF THE INVENTION

Figure 1:
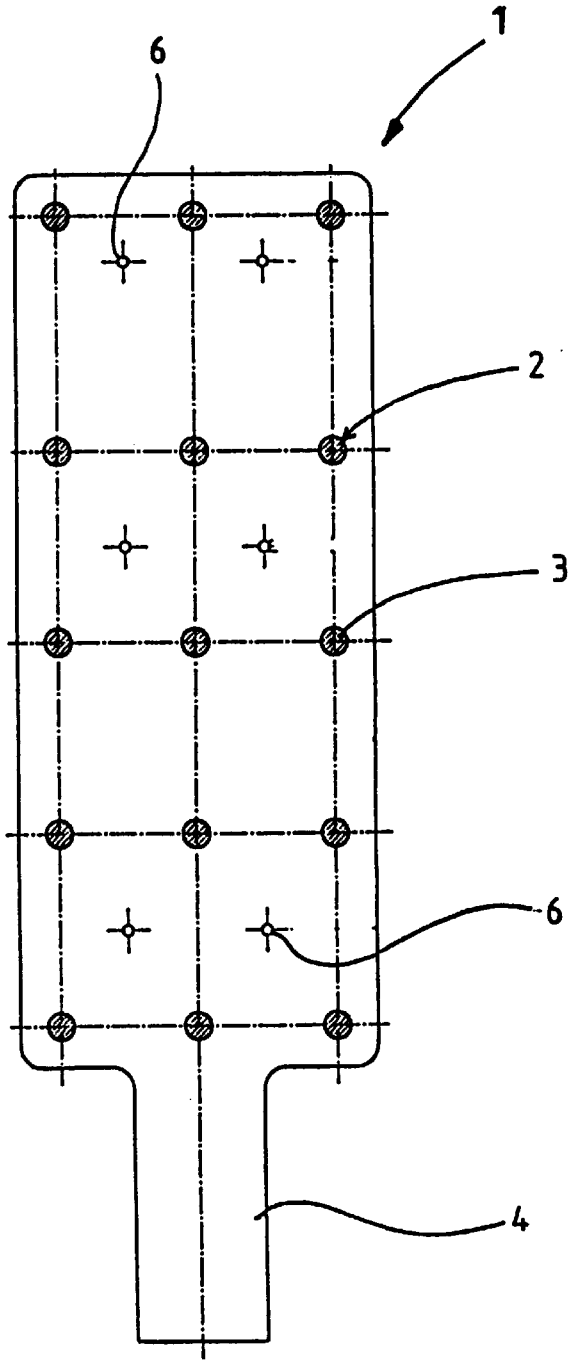
FIG. 1 is a front view of a membrane keypad of the present invention.

FIG. 1 shows a front view of a membrane keypad 1 of the invention. This membrane keypad is sealed against the effects of moisture and has, for example, fifteen contacts 2. Depending on the size of the keypad and/or the desired number of signals to be triggered by the keypad, the number of contacts 2 can be chosen without restriction. Each of the contacts 2 has two contact surfaces 3 extending into the keypad interior, which are in facing alignment with each other, and which are preferably mounted on opposed surfaces of the membrane keypad. The two contact surfaces are separated from each other by a cushion of air or gas within the membrane keypad and within a sealed contact chamber in the membrane keypad in which this cushion of air or gas is trapped and through which the switching travel of the contact surfaces occurs. If mechanical pressure is applied on a contact 2 the cushion of air or gas is compressed until the two contact surfaces 3 touch and the desired signal is triggered. When the application of pressure on the contact 2 ceases, the cushion of air or gas expands, returning the then contact chamber surfaces to their starting position and the contact 2 is reopened. The contact chambers may be formed as sub-chambers within the membrane keypad, linked together into groups of, for example, three by linking passages (not shown in the drawing) so that the pressure is equalized, thereby improving the switching action. An outstanding feature of this membrane keypad 1 or, more specifically, the contacts 2 which are separated by a cushion of air or gas, is the long service life (several million switching operations) and the low cost of manufacture. Moreover, embedded in the membrane keypad 1 in FIG. 1 but not illustrated, are printed conductors which are led out from the contacts 2 and their contact surfaces 3 via a tongue 4 so that the signals can be processed in an electronic or control unit. By being sealed against moisture, and triggering of the contact being insulated, the contacts 2 and the electrical connections taking the form of, for example, printed conductors or circuits are protected against contamination by dirt, and against corrosion or oxidation.

Figure 3A:
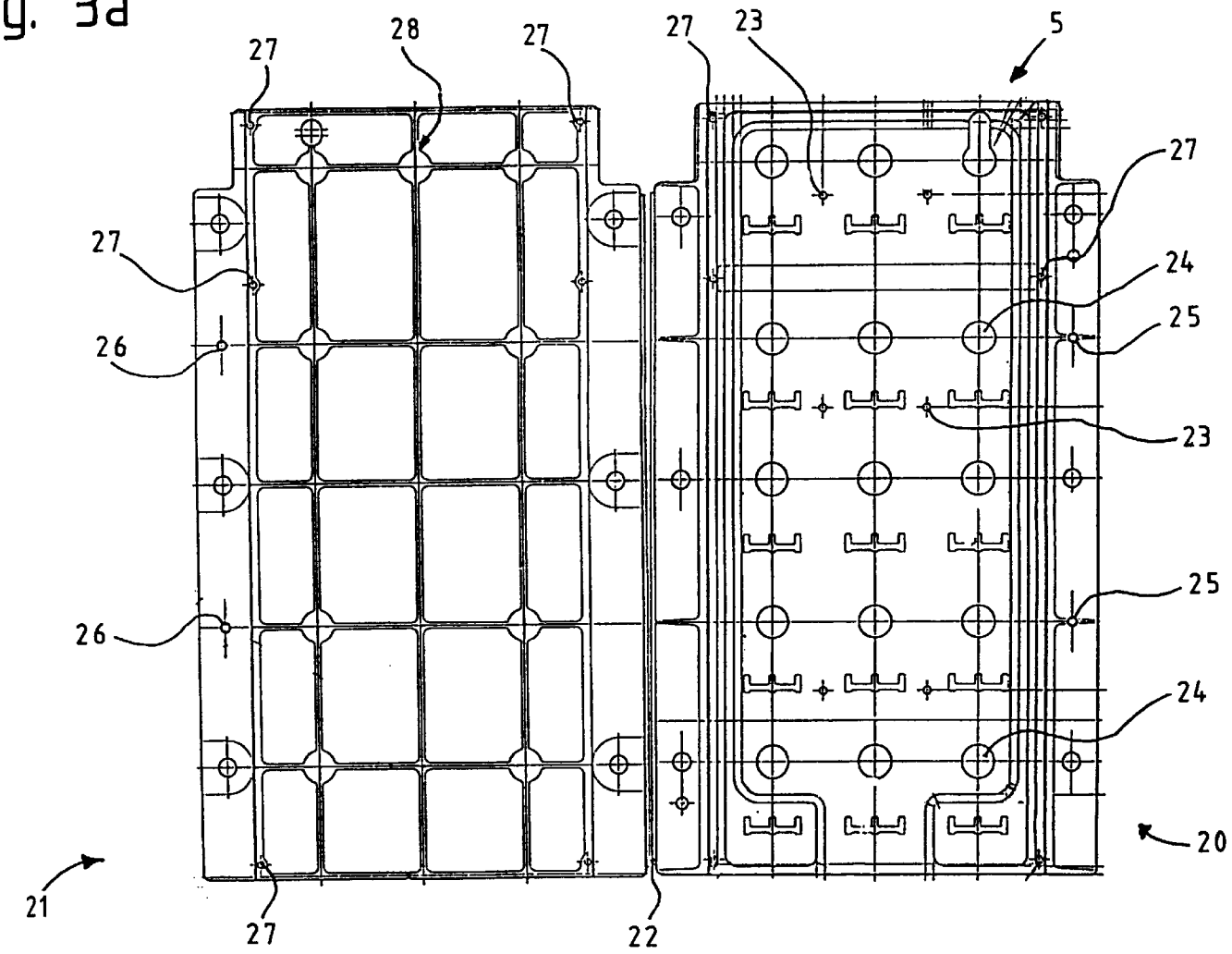
FIGS. 3*a,b* are a front view and a side view, respectively, of a carrier of the invention.
Figure 3B:
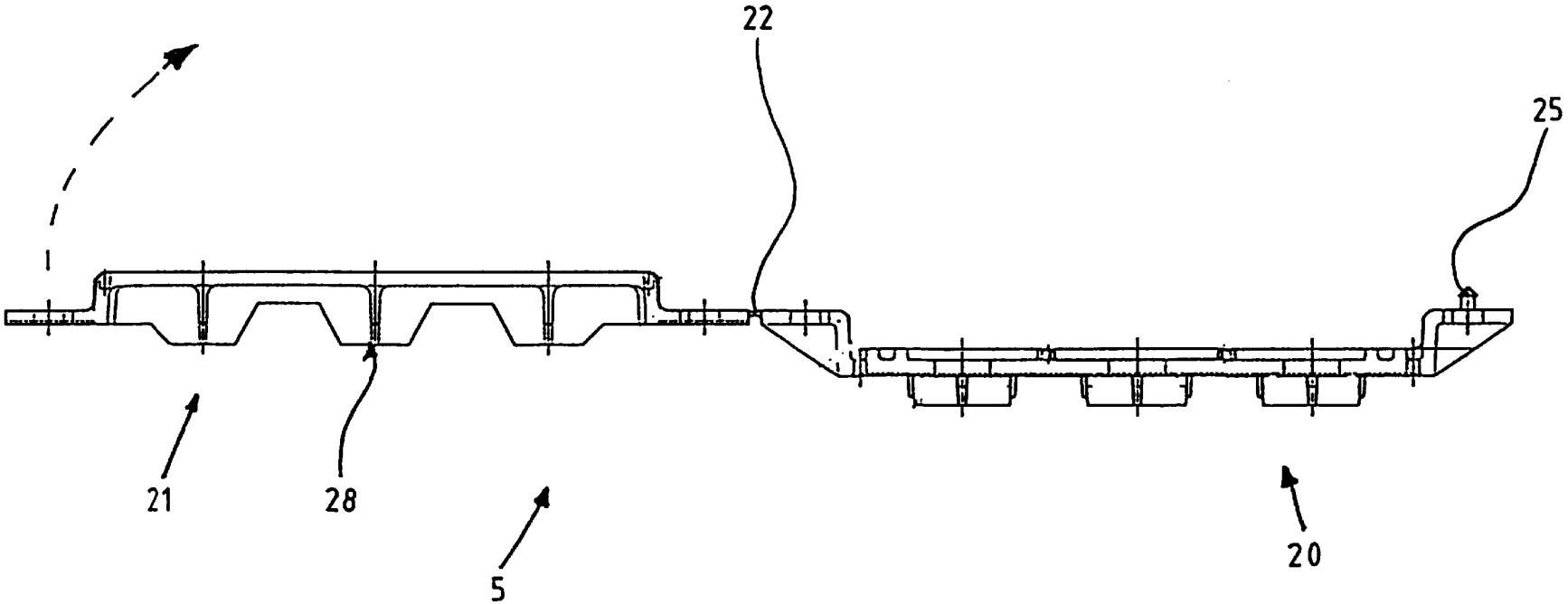

So that the membrane keypad 1 can be precisely positioned in a carrier or case 5 as shown in FIG. 3*a* and FIG. 3*b*, openings 6 are provided. These openings 6 are positioned so that they fit over pins located on the case 5 and the membrane keypad 1 is thereby fastened in place.

Figure 2A:
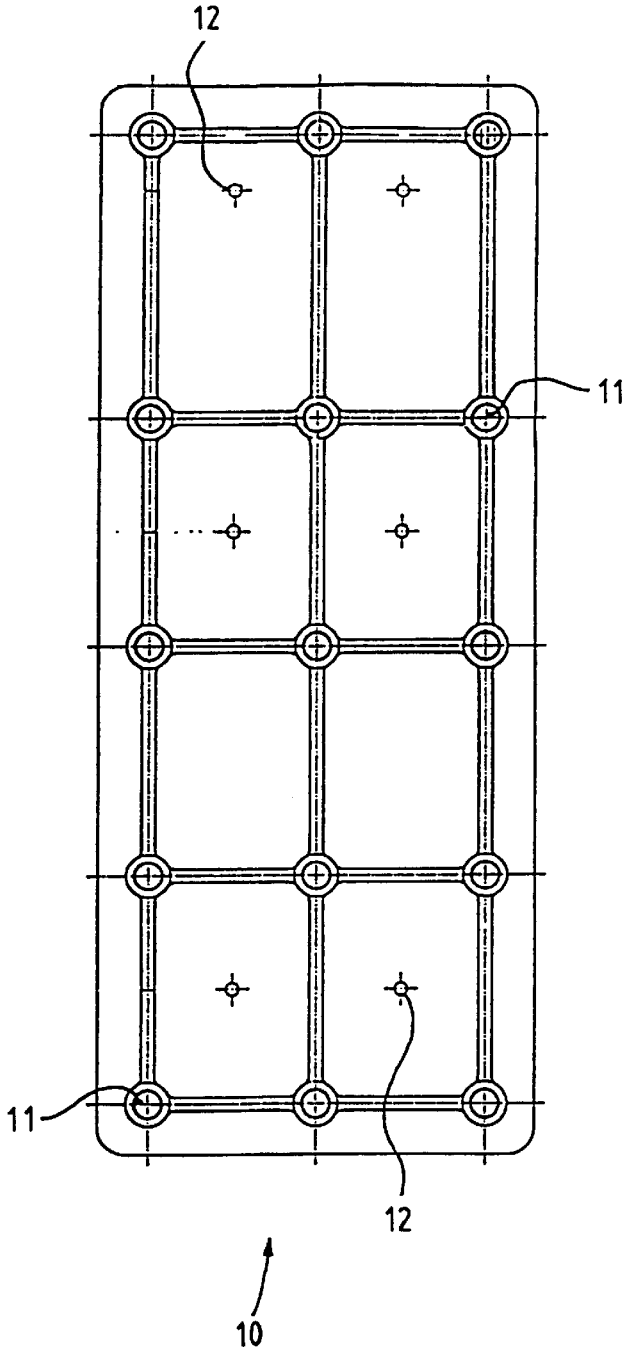
FIGS. 2*a,b* are a front view and a side view, respectively, of a keypad base of the present invention.
Figure 2B:
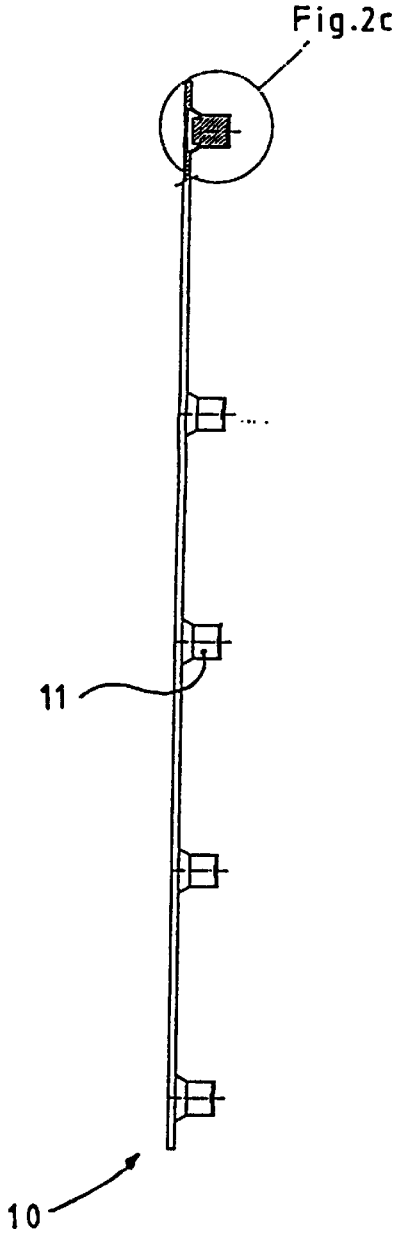
FIG. 2*c* is an enlarged detail view of a switching plunger.

FIG. 2*a* shows a front view and FIG. 2*b* a side view of a keypad base 10, which preferably is formed of silicone rubber or a material with similar characteristics. The keypad base 10 has switching plungers 11 whose number and positions correspond with the number and positions of the contacts 2 of the membrane keypad 1. There are also openings 12 in the keypad base 10 so that the keypad base 10 is positioned over the pins of the carrier 5 and the switching plungers 11 lie over the corresponding contacts 2 of the membrane keypad 1.

Figure 2C:
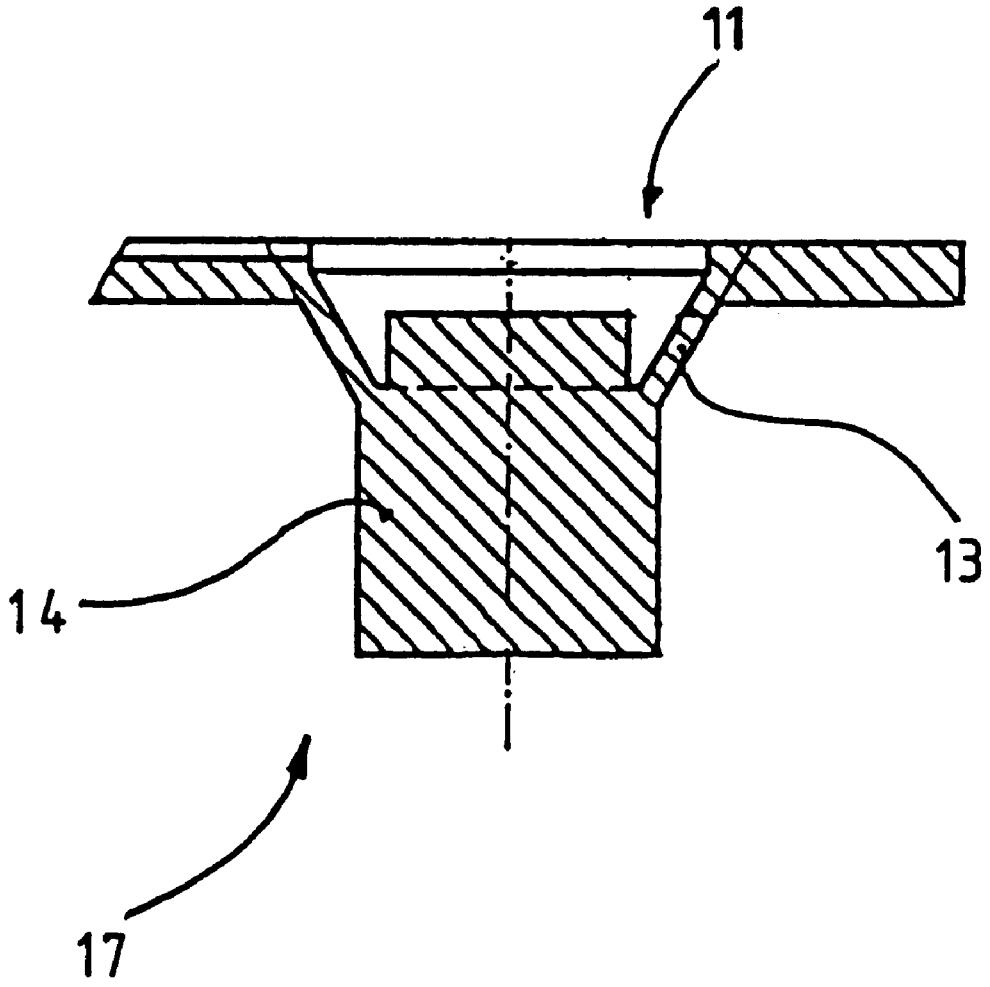

FIG. 2*c* shows an enlarged cross-section of a switching plunger 11 according to FIGS. 2*a* and 2*b*. The switching plunger 11 comprises a switching element 13 and a dome 14. The domes 14 of the switching plungers 11 are each constructed in such a manner that there is a defined switching point for the switching element 13. That is to say, the dome 14 has a precisely defined point at which it "snaps" or "clicks" upon a specified application of force on the switching plunger 11. The lower surface of the switching element 13 is then pressed onto the underlying contact 2 or, more specifically, the contact surface 3 of the contact 2 on membrane keypad 1 and thereby causes a signal to be triggered. When pressure upon the switching plunger 11 is released, the dome returns to its original position as shown in FIG. 2*c*. The keypad base 10 has openings 17 in the areas of the switching plungers 11 or, more specifically, the domes 14. This makes it possible for the switching element 13 to be pressed directly onto the underlying contact 2 of the membrane keypad 1.

In comparison with conventional keypads, the switching element 13 has no contact surfaces or contact pills, but serves only to activate a separate switching element generating the switch signal. The actual issuance of the switch signal takes place within the sealed membrane keypad 1 when the two contact surfaces 3 are pressed together.

FIG. 3*a* shows a front view and FIG. 3*b* a side view of a carrier or case 5. The purpose of this carrier 5 is to contain the membrane keypad 1 and the keypad base 10 and hold them in place. The carrier 5 consists of an upper part 20 and a lower part 21 which are joined together by means of a thin, foil-like hinge 22. The upper part 20, lower part 21 and hinge 22 may comprise one piece, so that the entire case 5 can be manufactured in an injection molding tool as a single piece. The lower part 21 has ribbing 28 taking the form of fins extending to at least a rear wall which serve to stiffen the carrier 5 as well as to distribute the force if there is excessive pressure on the keys. The upper part 20 contains pins 23 whose spacing matrix corresponds to that of the openings 6 in the membrane keypad and to that of the openings 12 in the keypad base 10, allowing alignment of those parts. There are also openings 24 in the upper part 20 whose spacing matrix corresponds to that of the switching plungers 11 of the keypad base 10. These openings 24 allow connection between the switching plungers 11 and the keys of a key module 16.

When first the keypad base 10 with the switching plungers 11 facing down into the openings 24, and then the membrane keypad 1 have both been inserted in the carrier or case 5 and each of the openings 6, 12 guided over the pins 23 and thereby fastened into place, the carrier 5 can be closed. As indicated in FIG. 3*b* by an arrow, the carrier 5 is closed by the lower part 21 being folded over at the foil hinge 22 onto the upper part 20. To hold the carrier 5 in the closed state a lock is provided. The lock may be of the type which can be closed only once. A lock which can be reopened for maintenance can also be used. For example, pegs 25 with conically shaped tips can be positioned on the upper part 20 which fit into holes 26 in the lower part 21, the diameter of the holes 26 being slightly smaller than the maximum diameter of the conical tip of the peg 25, locking the upper and lower parts together.

Figure 4A:
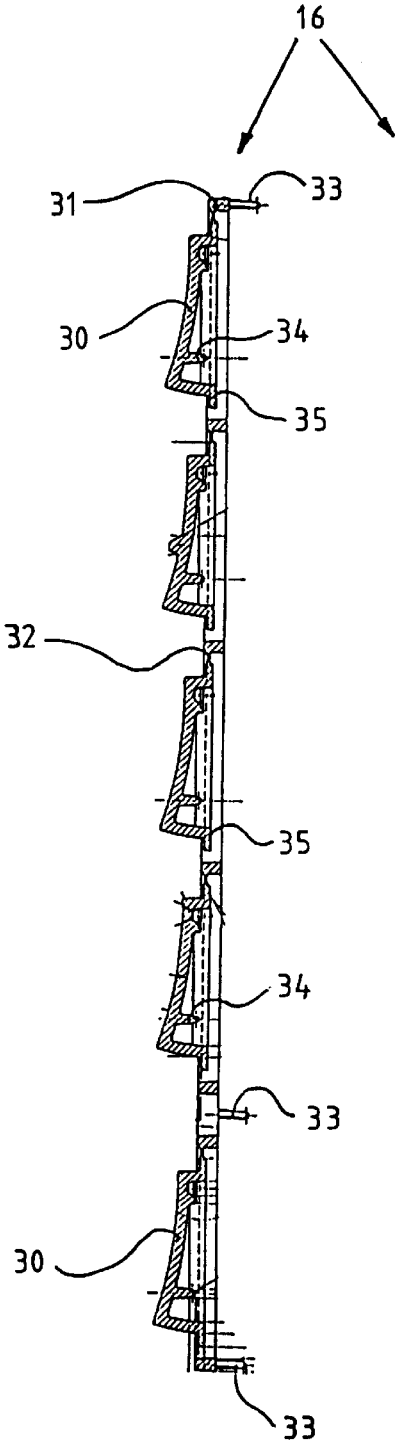
FIGS. 4*a,b* are a side view and a front view, respectively, of a key module.

The closed carrier or case 5 forms a complete, protected, and functioning unit and thereby considerably eases installation, since the keypad base 10 and the membrane keypad 1 can be installed in the carrier 5 at the factory and on site it is only necessary to place over them a key module 16 as illustrated in FIGS. 4*a* and *b*. For the purpose of mounting the key module 16 upon the carrier 5 there are fastening holes 27 in the upper part 20 and the lower part 21 which lie over each other when the carrier 5 is in the closed state and which accept mounting pins on the key module.

Figure 4B:
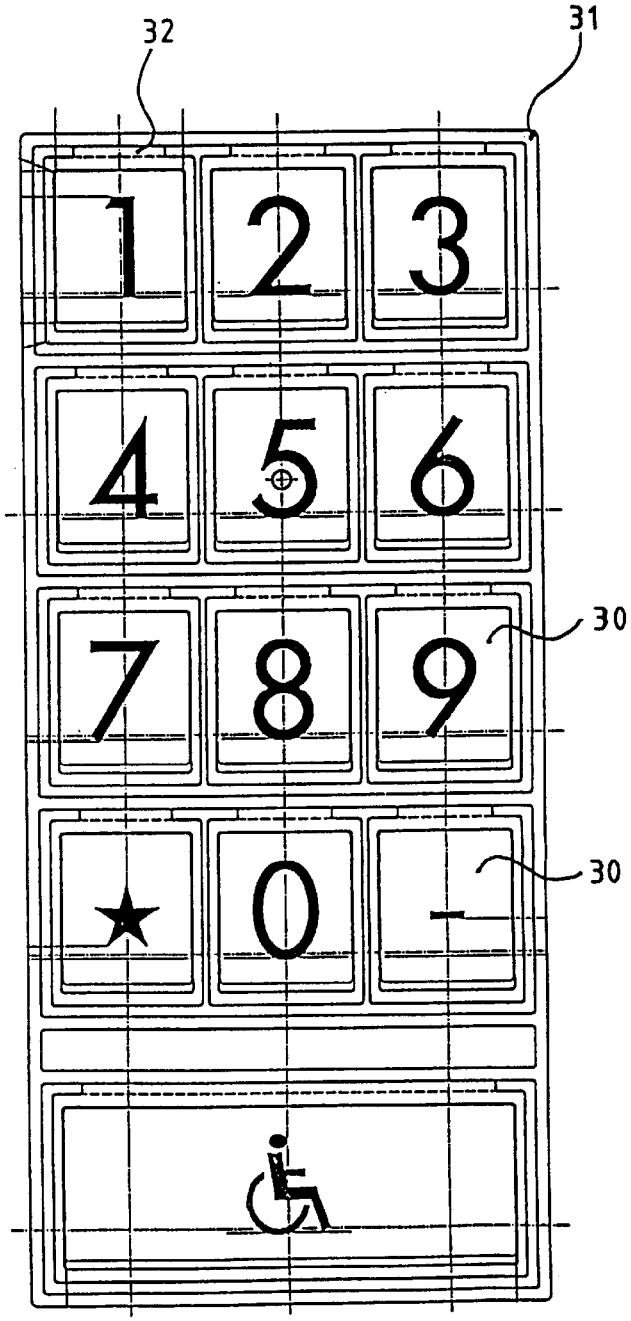

FIG. 4*a* shows a side view and FIG. 4*b* a front view of a key module 16. This key module 16, which may be, for example, in a specific form in which it can be used in an elevator installation, a ten-digit keypad with additional optional functions such as a "handicapped" button etc., is made in one piece, and consists of keys 30 and a frame element 31. Integral foil hinges 32 serve as the means of connecting the keys 30 to the frame element 31 and also permit the switching movement of the keys 30. The key module 16 can be made completely from a synthetic material, the keys 30 bearing symbols and/or figures of a contrasting synthetic material injected from behind the keys. Alternatively, the keys 30 themselves may be made of metal, for example die cast zinc, bearing figures and symbols of synthetic material injected from behind the keys, the remaining elements such as the frame element 31, frame portions for the individual keys, and the film hinge 32 supporting the key frame portions being made from synthetic material.

On the back of the key module 16 there are fastening pins 33 which can be used to mount the key module 16 onto the closed carrier 5 by pressing the fastening pins 33 into the corresponding fastening holes 27 in the carrier 5.

There is a switching strip 34 on the back of each key 30 which, when a key is pressed, creates the connection to the corresponding switching plunger 11 of the keypad base 10, the plunger then causing the signal to be triggered by the contact 2 on the membrane keypad 1. A stop 35 on the key 30 serves the purpose of limiting the switching stroke onto the switching plunger 11 and, if excessive force is applied to the key 30, of also preventing destruction of the keypad base 10 or the membrane keypad 1 by the stop 35 acting on the external surface of the closed carrier 5.

Figure 5:
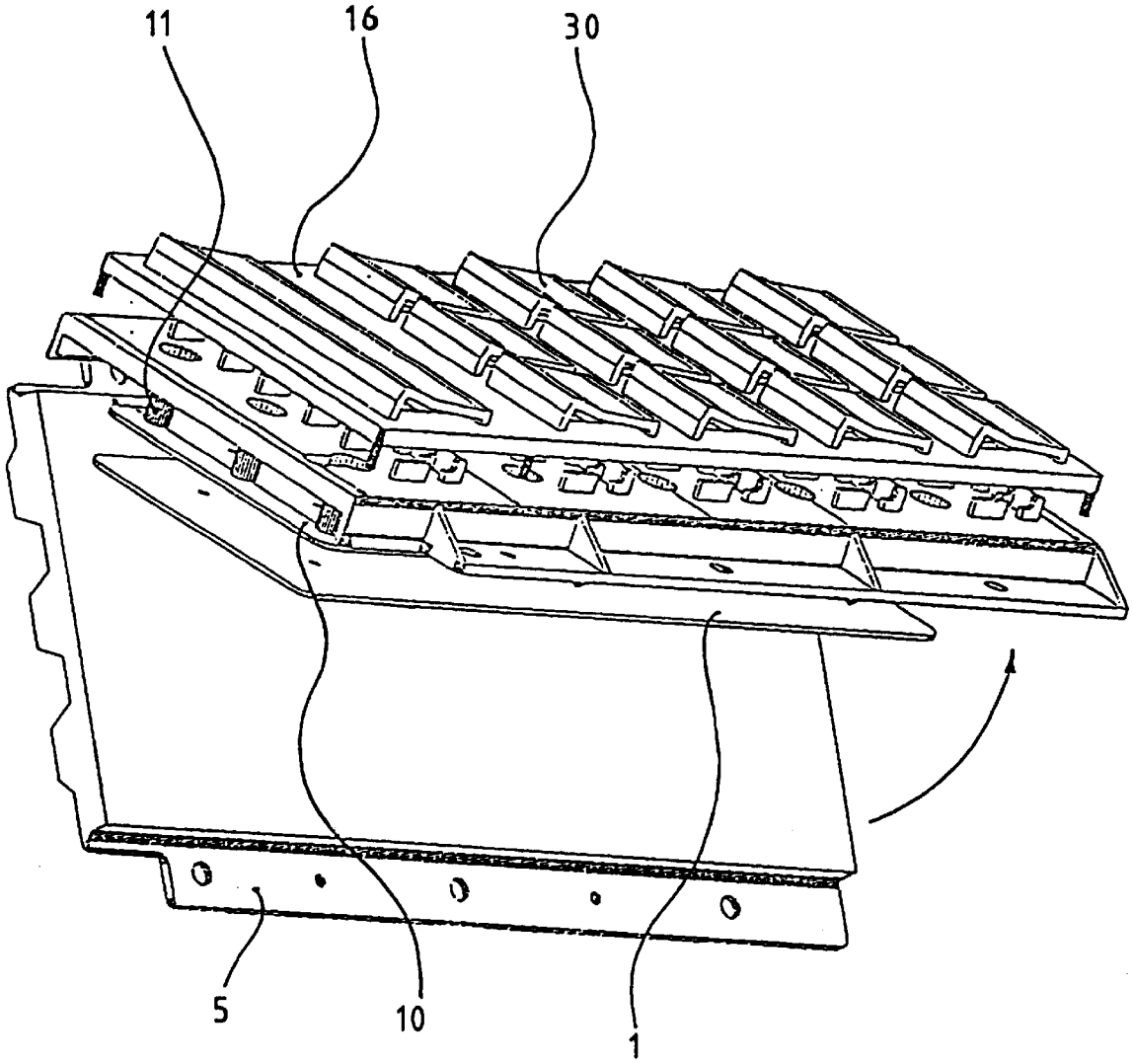
FIG. 5 is a perspective, exploded view of the complete keypad.

FIG. 5 shows a perspective, exploded view of the complete keypad. Following insertion of the membrane keypad 1 and the keypad base 10 into the open carrier 5 this is closed as indicated by the arrow and locked with the pegs 25. This closed unit can be preassembled and built into the terminal in a short space of time during production and can also be delivered directly to the job site as a spare part when required. This saves time during installation and, furthermore, the membrane keypad 1 and the keypad base 10 are protected from damage by the closed carrier 5. A further advantage is that no further fasteners are required to assemble the keypad. The key module 16 need finally only be mounted, such as by a "click" or "snap" fit, onto the carrier 5.

We claim:

1. A keypad for input of commands for an elevator control system, comprising a contact membrane including a plurality of aligned contact pairs; means for providing tactile feedback to a user upon actuation of said contacts; a casing for said contact membrane and said tactile feedback providing means; and a plurality of activating keys integrated in a key module removably located on a top of said casing, wherein said contact membrane comprises a flexible air-tight chamber having upper and lower surfaces normally separated by a gas cushion within the air-tight chamber, a first contact of each of the contact pairs located on the upper surface and extending within the air-tight chamber and a second contact of each of the contact pairs being located on the lower surface and extending within the air-tight chamber in a spaced relation to the first contact, the gas cushion being compressible by an application of a force to an exterior of the contact membrane at the location of a chosen aligned contact pair of the content pairs to allow the contacts of the chosen contact pair to come into electrical contact, the contacts of the chosen contact pair separating and returning to the spaced relation upon removal of the force, said means for providing tactile feedback comprising a tactile feedback mat having a plurality of switching plungers located upon said contact membrane in alignment with said contact pairs.

2. A keypad according to claim 1, characterized in that the switching plungers are made of silicone rubber and comprise a switching element (13) and a dome (14).

3. A keypad according to claim 1, characterized in that the carrier (5) consists of an upper part (20) and a lower part (21) which are joined together by a foil hinge (22).

4. A keypad according to claim 3, characterized in that the carrier (5) is locked in a closed state.

5. A keypad according to claim 3, characterized in that the lower part (21) of the carrier (5) has ribbing (28) in the form of fins.

6. A keypad according to claim 1, characterized in that the key module (16) comprises a frame element (31) and the keys (30) which are joined to the frame element by means of foil hinges (32).

7. A keypad according to claim 1, characterized in that the keys (30) include indicia formed of a synthetic material injected from behind the keys.

8. A keypad according to claim 1, characterized in that the keys (30) are provided with a stop (35).

* * * * *